US006334443B1

(12) United States Patent
Olsen

(10) Patent No.: US 6,334,443 B1
(45) Date of Patent: Jan. 1, 2002

(54) HIP PROTECTOR

(76) Inventor: Hans Olsen, Usseroed Kongevej 85B, Hoersholm (DK), DK-2970

( * ) Notice: Subject to any disclaimer, the term of this patent is extended or adjusted under 35 U.S.C. 154(b) by 0 days.

(21) Appl. No.: 09/600,883

(22) PCT Filed: Feb. 18, 1999

(86) PCT No.: PCT/DK99/00069

§ 371 Date: Aug. 14, 2000

§ 102(e) Date: Aug. 14, 2000

(87) PCT Pub. No.: WO99/42011

PCT Pub. Date: Aug. 26, 1999

(30) Foreign Application Priority Data

Feb. 18, 1998 (DK) ..... 0232/98

(51) Int. Cl.[7] ..... A61F 13/00

(52) U.S. Cl. ..... 128/846; 128/888; 128/892

(58) Field of Search ..... 128/845, 846, 128/888, 889, 891, 882; 2/22, 23, 24, 267, 455

(56) References Cited

U.S. PATENT DOCUMENTS

| | | | | | |
|---|---|---|---|---|---|
| 4,641,641 | A | * | 2/1987 | Strock | 128/888 |
| 4,926,883 | A | * | 5/1990 | Strock | 128/888 |
| 5,020,547 | A | * | 6/1991 | Strock | 128/891 |
| 5,062,433 | A | * | 11/1991 | Kummer | 128/888 |
| 5,722,093 | A | * | 3/1998 | Andresen | 2/23 |

* cited by examiner

*Primary Examiner*—Michael A. Brown
(74) *Attorney, Agent, or Firm*—Jacobson Holman, PLLC

(57) ABSTRACT

A device for protecting a user against lesions, mainly bone lesions and especially fracture of the neck of the femur. The device includes a shell, a fastening structure and an adhesive part. The shell has a concave and a convex side. The adhesive part includes a skin-friendly adhesive suitable for long-term contact with the skin. The fastening structure is fixed near the peripheral zone of the shell on the concave side thereof, and is fixed on the adhesive part inside the peripheral zone of the shell. The fastening of the adhesive part to the first coupling part of the fastening means is done by a non-permanent attachment.

20 Claims, 2 Drawing Sheets

HIP PROTECTOR

FIELD OF THE INVENTION

This invention relates to a device for protection against injury, particularly bone fracture and especially fracture of the upper part of the femur, said device comprising shell means with a concave side facing the user and an opposite convex side, an adhesive area comprising a skin friendly adhesive suitable for long-term adhesive contact with the user's skin, and a fastening means for connecting the shell means with the adhesive area in which the fastening means comprises a connecting part and a first coupling part for connecting to the shell means in a releasable connection to a second coupling part on the adhesive area.

BACKGROUND OF THE INVENTION

Physical injury to humans may be divided in injury of the bone structure and injury of soft tissue. When protecting against injury of bone it is necessary to direct the forces that could lead to fracture or lesions to the surrounding soft tissue.

It is known that elderly people especially due to deterioration of agility and balance, maybe combined with bad eyesight and insufficient lighting conditions, are more prone to falling. Often the falls of elderly people are of a character leading to long term hospitalisation due to the complexity of the fracture, osteoporosis and a slower healing process. Some of the types of fractures that elderly people are exposed to have a character that demands insertion of a bone prosthesis in order to get a sufficient mobility. Another aggravating circumstance is that elderly peoples fat tissue and muscles often are not firm or thick enough to function as a shock-absorbing medium in a fall.

In Denmark there are app. 14,000 cases of fractures of the upper part of the femur per year. Operation and care of these patients lead to a total of 300.000 days in bed corresponding to 3–4% of the total occupation of beds in hospitals per year in Denmark. In the next decade a steep rise in the number of fractures of the upper part of the femur is to be expected due to the increasing number of elderly people. Development of new and better medicine to prevent osteoporosis can be expected to reduce this rise.

Patients suffering from a fracture of the upper part of the femur often get a reduced quality of life as only about 20% regain full mobility. Moreover, app. 20% die within the first year. Operation of fracture of the upper part of the femur, the following nursing and rehabilitation and optional relocation from home to nursing home is already costing the Danish society app. 1 billion Danish kroner per year.

It has been found that the energy absorption around the hip seems to play a greater role in the occurrence of hip fractures than the ultimate strength of the bone itself, which, as a rule, is deteriorating with increasing age. The soft tissue surrounding the hip influences the energy absorption in case of a fall, a fact that partly explains the smaller risk of fracture for obese people.

An effective protection device therefore must act as a means to primarily distribute the energy from the upper part of the femur to the surrounding soft tissue but also as a device absorbing the energy.

Several devices have been proposed for wearing on the outside of the hip joint for protection against possible injury.

U.S. 5,157,789 discloses a hip protective hospital garment, adapted for use by individuals of all sizes, which includes a gown having a lower portion, a pair of upper chest flaps, and a pair of shoulder flaps, wherein the upper chest flaps are adjustably and criss-crossingly connected with the pair of shoulder flaps so as to provide a comfortable, quick, and non-restrictive fit on the individual user. Extending across an interior side of the lower portion is a large, sealable pocket disposed in substantially covering relation to the hips and upper thighs of the wearer, the pocket being structured to receive at least one lightweight, flexible, impact protective air bubble material liner therein so as to provide a protective area that will substantially absorb a force of impact to the hip area of the wearer, and thereby reduce the severity of injuries which may occur from accidental falls. The protective air bubble liner is so situated as to serve the added purpose of reducing risk of stasis ulcers or bed sores.

U.S. 4,737,994 discloses an undergarment to which is applied pocket-forming fabric comprising a pair of portions forming pockets positioned so as to overlie opposite hip regions of the wearer and a connecting portion extending along the waist line of the garment and forming a passage joining the two pockets. An impervious inflatable bag inserted through the entrance into the pockets has an inflatable cushion-forming portion in each pocket and a connecting portion joining the cushion-forming portions. The bag is inserted in deflated condition and is then inflated to provide over each hip region of the wearer an air cushion for cushioning the impact in the event of a fall.

EP 83 454 discloses a device to protect a body sensitive to impact or pressure, e.g. the backbone of a two-wheeled vehicle rider or of an athlete. The device is an upholstery comprising several, at least partially uniform, essentially compression-resistant elements expediently in the form of blocks or loops arranged essentially directly adjoining one another and joined flexibly and with high tension strength to one another along their inner surfaces or edges facing the body.

DE 36 38 718 discloses a pair of trousers for medical purpose in which a part around the upper thigh is provided with a pocket in which a covering device with upholstery is placed for protecting against fracture of the upper part of the femur. The hip protecting device is in the form of a pair of trousers, and must be removed e. g. when bathing or going to the toilet. A lot of hip fractures, around 20%, comes from falling on the often hard and slippery floors during bathing and going to the toilet.

EP 99 010 discloses an impact dissipator for the protection of bones and organs of the human body from impacts or falls. The dissipator is bell-shaped and has an outer layer which consists of an elastic rubber substance. Within the shell-like outer layer a viscous fluid layer is located, which is bonded thereto, with the fluid layer forming a skin-friendly adhesive layer adapted to contact and conform to the area being protected.

U.S. 5,062,433 discloses a protector to prevent hip fractures and/or bedsores and/or protect a wound or wound area formed from an outer load bearing member reinforced by internal ridges. The protector is dome-shaped with structured ridges to form an internal dome or clearance for the region of desired protection. A soft inner sheet is attached for comfort.

U.S. 4,641,641 discloses a protective appliance for the hip joint area comprises an annular pad made of a relatively resilient material and carrying adhesive strips on one surface to secure the pad to the skin, and a relatively rigid dome-shaped shield carried in opposed pockets formed on the other, outer surface of the pad. The shield fits somewhat loosely in the pad pockets to permit it to adjust to changes in body position, thus adding to the comfort of the appliance when it is worn. The sides of the shield disposed between the pad pockets are contoured out of the plane of the pad to add further comfort particularly when the wearer reclines on the appliance.

None of these devices, however, have gained widespread acceptance or have been used to a greater extend. One disadvantage is the mounting, where an accurate location is necessary in order to give a suitable protection. The mounting is often rather troublesome combined with the fact that the devices are not very comfortable to wear. Furthermore there are problems with involuntary removal when e.g. shorts are removed.

In the protection device known from U.S. 4,926,883 an attempt has been made to remedy these drawbacks. This patent discloses a protective body appliance comprising a generally dome-shaped rigid shield secured to a flexible, compressible pad. The pad has an inner section that is adhered to the wearer's body, and an outer section to which the rigid shield is attached. The inner pad section has two lateral wings separated by a centre region all of which form an exposed surface which is placed against the wearer's body. The inner pad section is mated to the outer pad section along the centre region so that the wings are movable relative to the outer pad section. The wings permit the shield and outer pad section to shift or rock relative to the inner pad section in response to body movements and external forces, thus increasing the appliance's ability to remain adhered to the wearer over time.

The protection device known from U.S. 4,926,883 must be expected to be expensive in use, as the exchangeable parts comprise the complete pad and the complete adhesive part. These parts are furthermore very large as they must extend to and support the end parts and the periphery of the hard shell. The protection device is claimed to allow movement of the hip, but the large pad and adhesive part vil be hampering the movement of the skin under the large adhesive area. Furthermore the mounting is rendered difficult by the many different operations to be carried out.

Thus, there is still a need of an efficient hip joint protection being cheap in use, readily placeable and, at the same time, securely staying in place. The protecting device must at the same time not take up too much room and must possess an adequate wearing comfort so that it can be worn or used for extended periods of time or permanently, meaning both day and night. It is the purpose of the present invention to provide a protection device distributing the forces from the bones, especially the neck of the femur, which is considered the critical area, and absorbing energy to a certain degree.

Furthermore, the protection device must be simply designed and employ a simple fastening principle, so that elderly people can understand the handling of the device by themselves.

The adhesive part must be easy to place and replace accurately on the skin over the neck of the femur, and the area of the adhesive must be made as small as possible so that the overall flexibility of the skin area is as close to natural as possible.

When exposed to an impact, a suitable large area of soft tissue around the neck of the femur should take up the forces.

Furthermore the protection device should be cheap in use, and hence, as large a part as possible of the device should be reusable, when the adhesive, which is a disposable article, is replaced. The adhesive area is for comfort reasons to be as small as possible, which also will make the device cheaper in use.

The invention relates to a device for protecting against lesions, mainly bone lesions and especially fracture of the neck of the femur comprising shell means having a concave side facing the user when mounted and an opposite convex side, an adhesive area comprising a skin friendly adhesive suitable for long-term adhesive contact with the user's skin, and a fastening means connecting the shell means with the adhesive means, in which the fastening means comprises a connecting part and a first coupling part for detachably connecting the shell means with the second coupling part of the adhesive means.

The invention is characterised in that the connecting part of the fastening means is permanently fixed to the shell means on the concave side hereof near a peripheral zone, and that the first coupling part is fixedly connected to the connecting part and placed centrally with respect to the shell means, and that the first coupling part is connected to the connecting part by an area substantially smaller than the area of the coupling part, that the second coupling part is connected through an area larger than the first coupling part and that the area of the skin friendly adhesive of the adhesive means is larger than the contact area of the second coupling part but substantially smaller than the peripheral extent of the shell means.

In this embodiment, the shell means and the fastening means will act as an integrated and reusable unit providing the desired good shock-absorbing and impact-distributing function, at the same time being easy for the user to place and remove intently and furthermore being cheap in use, as only the small adhesive part is substituted.

The coupling part on the fastening means is provided with a relatively in elastic lug placed on the edge of the coupling. The length of the lug is advantageously adjusted so that the outer end of the lug is hidden under the shell means during normal use. In a preferred embodiment the lug is oriented upwards in use. This construction has the effect that, in the case of an unintended pull in the shell means, the forces must be very large to separate the coupling parts, whereas in case of an intended pull in the lug on the coupling part of the fixing means, only small forces are necessary to pull them apart.

It has proven advantageous if the connecting part is elastic as the elasticity reduces the pull of the skin when the skin and the shell means move relative to one another. The reduced pull of the skin means that the use of a smaller adhesive area is possible and that the protection device can be worn for a longer period of time.

In order to facilitate an accurate placing, the adhesive may be provided with a centrally located hole of a diameter of 8 to 10 mm, said hole functioning for sighting and marking, ensuring that the correct site for placing the adhesive can be marked with a small spot, so that a precise repositioning of a substitute adhesive can take place.

Similarly, the shell means may be provided with a larger centrally placed hole and the fastening means provided with an 8 to 10 mm hole in the fastening area of the corresponding coupling part for aiming purposes. Furthermore, this permits use of a guiding pin or pencil, temporarily placed in the aiming hole of the adhesive means, for easy and precise placing of the shell means and the fastening means in the correct position over the coupling part of the adhesive means. The pressure necessary for coupling is easily established through the hole in the shell means, provided that the hole in the shell means has an adequate size for passage of e. g. a finger.

In this way it is achieved, that the protection device in use, during moving and normal shifting of posture always is placed opposite the point of the bone considered the most critical, and the shell means can, due to the precise placing, perfectly distribute the load into the surrounding soft tissue.

With this division of the shell means and fastening means as first reusable part and the adhesive means as a second disposable part, a system is provided which is, at the same time, effective and cheap in use.

According to the invention, the fastening areas of the connecting part may be provided in two diametrically opposed areas of the shell means, preferably along the axis of the largest extension of the shell means.

According to the invention, the adhesive means may comprise an adhesive and a coupling part, which coupling part may comprise a hook or loop layer, snap fasteners, adhesive or magnets so that a detachable attachment may be achieved between the fastening means and the adhesive means.

Still further, according to the invention, the peripheral zone of the shell means may be curved in such a manner that it forms a convex surface facing the user, which convex surface is sufficiently large to distribute the impact forces induced by a fall along the periphery of the shell means. In this way it is achieved, that under load the pressure is distributed along the peripheral zone and not to the adhesive means placed in the vulnerable area.

To improve the comfort and in order for allowing the use of the device around the clock, i. e. also during sleeping, the part of the peripheral zone of the shell means facing the skin may be provided with a thin foam body. The foam body may be extended to cover the edge of the shell means.

By mounting the shell formed hip protectors directly on the skin it is rendered possible to wear the hip protector also during bathing and using the toilet, which as mentioned above is very important as app. 20% of falling accidents occurs in these situations.

BRIEF DESCRIPTION OF THE DRAWINGS

The invention is explained in more detail with reference to the drawings in which FIG. 1 Shows in perspective the hip protection device according to the invention.

DETAILED DESCRIPTION OF THE DRAWINGS

Figure 1:
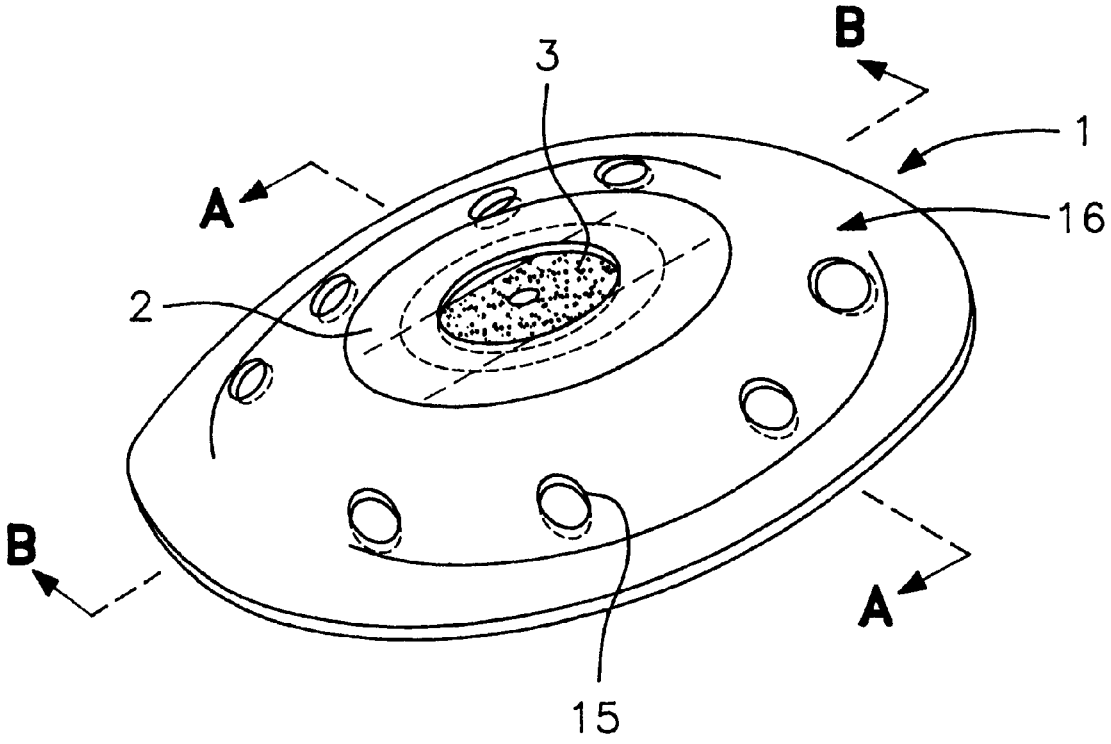
Figure 2:
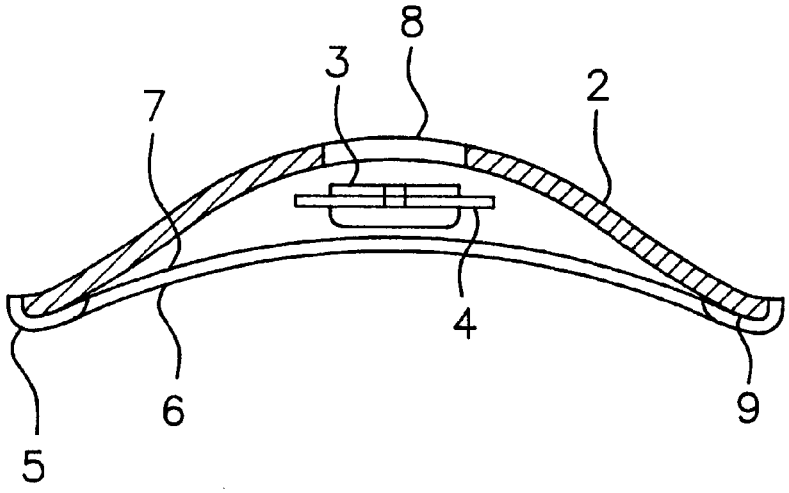
FIG. 2 Shows a section along the line A—A in FIG. 1

Reference is made to the drawings which show a protection device in the form of a hip protector 1. The protection consists of two individual units, the adhesive means 4 and the shell means 2 having a fastening means 22. One unit, the adhesive means 4, comprises a second coupling part 19 and a skin friendly adhesive 18, the other unit comprises the dome shaped shell means 2 and the fastening means 22 comprising the connecting part 3 and the first coupling part 20. In a preferred embodiment the peripheral zone 9 of the shell means is provided with a foam body 5.

In the embodiment shown, the shell means 2 is shaped like an oval shell measuring e. g. 10 by 14 centimeters and dome-shaped with a height of app. 2 centimeters.

Proximate to the peripheral zone 9 on the concave side 6 of the shell means 2 the connecting part 3 is fastened to the shell means 2 with one or more permanent fastenings 12. The fastening may be done with an adhesive or by welding.

The connecting part 3 comprises in the embodiment shown an elastic band, on which, approximately in the middle is fixed permanently the first coupling part 20, comprising in the embodiment shown a burr-like material. The fixing area 13 between the elastic band and the coupling part 20 is significantly smaller than the area of the coupling part 20, meaning that you do not pull at the edge of the coupling incurring that the coupling parts 10 and 19 can not be peeled apart when pulling in the fastening means 22 via the shell means 2.

The coupling part 19 comprises a loop-like material. The coupling parts 19 and 20 may also be made with adhesive or magnets.

The skin adhesive area of the adhesive means, i. e. the area of the skin-friendly adhesive 18, is substantially smaller than the area of the shell means 2, but is larger than the area of the coupling part 19. The adhesive means is placed within the periphery zone 9 of the shell means 2, and the coupling part 19 on the adhesive means 4 is larger than the coupling part 20 of the fastening means 22.

With this construction it is achieved, that at all times when pulling in the shell means 2, the pulling forces attack at a distance from the edges of the individual parts of the system, and that consequently a large force is necessary if the two coupling parts 19 and 20 are to be separated by accident. Also the edge area of the skin adhesive is comparatively unstressed, so that peeling between the adhesive and the skin can be avoided.

The suspension or connecting part 3 is preferably made from a broad elastic band, in which the pre-tension is adjusted according to the fact, that the shell means 2 must be able to move and follow the skin when moving, e. g. when changing from a standing to a sitting position, so that the shell means always will cover the neck of the femur.

The connecting part 3 is in the embodiment shown permanently fixed to the shell means 2. The permanent fixing 12 between the shell means 2 and the connecting part 3 is in a more preferred embodiment in the form of two areas placed diametrically opposed on the shell means, preferably longitudinally to the largest extension of the shell means.

Figure 3:
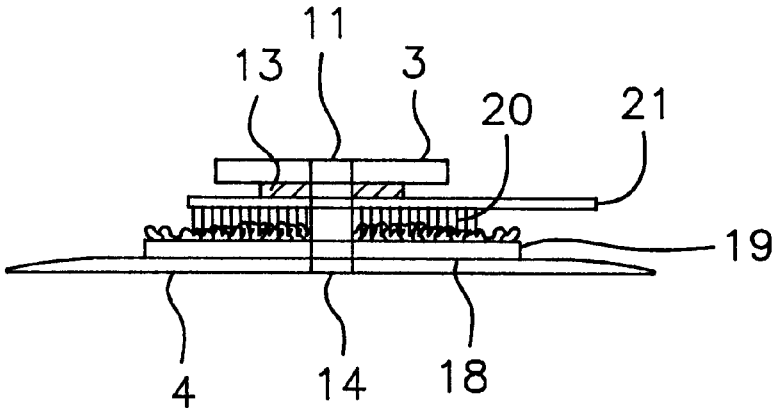
FIG. 3 shows a sectional view of the adhesive means and the fastening means
Figure 4:
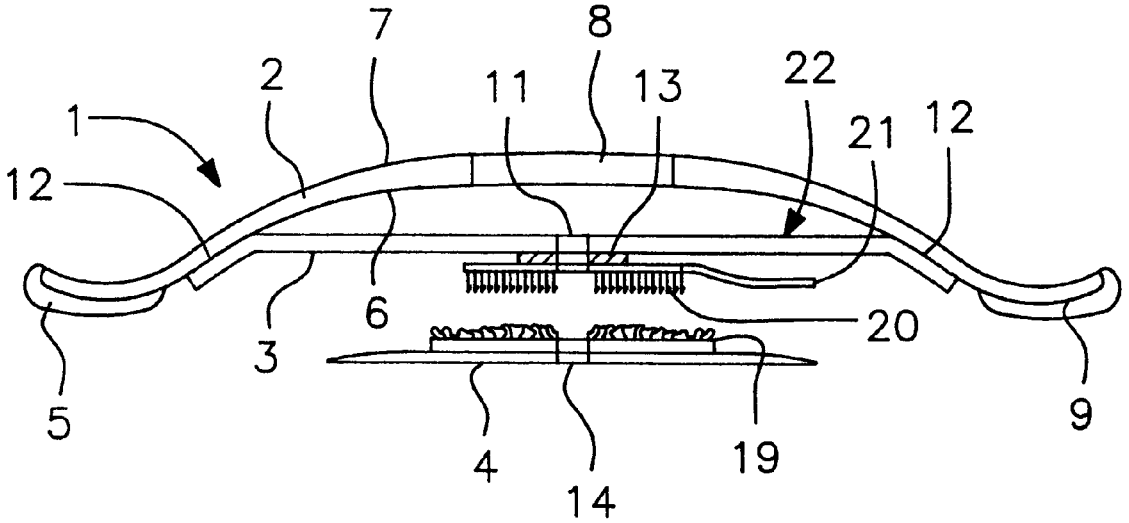
FIG. 4 Shows a section along the line B—B indicated in FIG. 1 in which the coupling means are separated.

In the embodiment shown in FIG. 3, the fixing points 12 between the connecting part and the concave side 6 of the shell means 2 are shown. The convex side of the shell means is marked 7.

The fixing of the adhesive means to the skin must take place exactly over neck of the femur. In order to carry out this as precisely as possible, the adhesive means preferably is provided with a hole 14 for marking and alignment. Accordingly the fastening means preferably is provided with an alignment hole in the fixing area 13, i. e. the alignment hole goes through the connecting part 3 as well as the coupling part 20.

Before the adhesive means is fastened to the skin, the centre of the neck of the femur can e.g. be marked with a small spot. The alignment hole of the adhesive means may be placed over the marking. In a more preferred embodiment the alignment holes 11 and 14 must not exceed 10 mm, so that by placing a pencil in the alignment hole 14 of the adhesive it is possible to guide the fastening means 22 and the shell means 2 in place by letting them slide along the pencil and against the coupling part 19 of the adhesive means.

When the alignment hole 11 of the fastening means and the shell means 2, e.g. via the pencil, are placed in line with the alignment hole 14 of the adhesive means 4 and the longitudinal direction of the shell means is aligned with the femur, the coupling part 20 is pressed against the coupling part 19 with a finger through the hole 8 of the shell means 2.

The change of radius of curvature in the peripheral zone of the shell means 2 in a more preferred embodiment causes the peripheral zone 9 to have an increased area of contact against the skin outside the area in which the neck of the femur is situated. In this way a pressure, e.g. arising from sleeping with the shell mounted, is dispersed to the surrounding soft tissue via a wide surface. The peripheral zone 9 of the shell means 2 may also in a more preferred embodiment be provided with a soft foam body or rubber lining 5, e.g. a semi-hard foam or soft rubber, to obtain a softer contact with the skin, when the shell means 2 are loaded.

The shell means 2 are made from a relatively rigid material, e. g. Acrylic, PMMA, having a modulus of elasticity around 3300 Newtons per square mm. An appropriate thickness would be app. 3 mm. Other suitable types of plastic may be used, e. g. Polycarbonate, PC, which is a little less rigid, but much more impact resistant than acrylic. The materials should stand washing at 60 degrees Celsius in an ordinary washing machine.

To ensure an easy intentional removal of the shell means 2 and the fastening means 22 when so desired, a more preferred embodiment has a dismounting lug 21 positioned on the edge of the coupling part 20 of the fastening means 22. In a more preferred embodiment the lug is placed so that in normal use it will point upwards and as a whole be inside the periphery of the shell means.

The shell means 2 may, apart from the centrally placed hole 8, be provided with a number of smaller holes 15 to ensure ventilation.

It has proven expedient to use the protection device to prevent bedsores. Bedsore or pressure sore often occurs on the skin in places where bone protrusions are exposed to increased pressure during longer periods of confinement to bed.

What is claimed is:

1. A device for protecting against lesions comprising:

shell means having a concave side facing the user when mounted and an opposite convex side;

an adhesive part including a skin friendly adhesive suitable for long-term adhesive contact with the user's skin;

a fastening means connecting the shell means with the adhesive part, said fastening means having a connecting part and a first coupling part for detachably connecting the shell means with a second coupling part of the adhesive part;

said connecting part of the fastening means being permanently fixed to the shell means close to a peripheral zone on the concave side thereof, said first coupling part being connected to the connecting part via an area which is substantially smaller than an area of the first coupling part and said second coupling part having an area larger than the first coupling part, and said skin friendly adhesive of the adhesive part having an area larger than an area of said second coupling part but substantially smaller than an extent of a periphery of the shell means.

2. The device for protecting against lesions according to claim 1, wherein the first and the second coupling part are selected from the group comprising a coupling means, a burr, a hook device, a nap and loop device, magnets or adhesives.

3. The device for protecting against lesions according to claim 1, wherein the connecting part is elastic.

4. The device for protecting against lesions according to claim 1, wherein the shell means is made as an oval dome and the connecting part is secured to the shell means in two diametrically opposed areas on the shell means.

5. The device for protecting against lesions according to claim 1, wherein the adhesive part is provided with an alignment and marking hole having a diameter smaller than 10 mm.

6. The device for protecting against lesions according to claim 1, wherein the fastening means is provided with an alignment and marking hole having a diameter less than 10 mm.

7. The device for protecting against lesions according to claim 1, wherein the shell means is provided with a hole in the central part thereof.

8. The device for protecting against lesions according to claim 1, wherein the peripheral zone of the shell means is curved such that it forms a concave surface facing against the concave surface of the surface of the shell means, and a convex surface facing the user, which convex surface is sufficiently large for dispersing pressure following a fall along the peripheral zone of the shell means.

9. The device for protecting against lesions according to claim 8, wherein the convex surface and around the edge of the peripheral zone of the shell means against the user is fastened a ring-shaped elastic foam body.

10. The device for protecting against lesions according to claim 1, wherein a pulling lug is placed on an edge of the coupling part of the fastening means.

11. The device for protecting against lesions according to claim 10 wherein the pulling lug in normal use is pointing upwards and as a whole is lying inside the periphery of the shell means.

12. A device for protecting a user against lesions comprising:

a shell having a concave side facing the user when mounted and an opposite convex side;

an adhesive part including a skin friendly adhesive suitable for long-term adhesive contact with the user's skin;

a fastening structure connecting the shell with the adhesive part, said fastening structure having a connecting part and a first coupling part for detachably connecting the shell with a second coupling part of the adhesive part, said connecting part being connected to the shell close to a peripheral zone on the concave side of said shell, said first coupling part being connected to the connecting part and placed centrally with respect to said shell, and each of said adhesive part and said fastening structure having an area substantially smaller than an extent of a periphery of said shell.

13. The device for protecting against lesions according to claim 12, wherein said second coupling part has an area larger than the first coupling part.

14. The device for protecting against lesions according to claim 12, wherein said skin friendly adhesive has an area larger than an area of said second coupling part.

15. The device for protecting against lesions according to claim 12, wherein the first and the second coupling parts include cooperating coupling elements selected from the group including a burr device, a hook device, a nap and loop device, magnets and adhesives.

16. The device for protecting against lesions according to claim 12, wherein the peripheral zone of the shell is curved to form a concave surface facing against the concave surface of the surface of the shell, and a convex surface facing the user, said convex surface being sufficiently large to disperse pressure along the peripheral zone of the shell.

17. The device for protecting against lesions according to claim 16, further comprising an elastic foam body on the convex surface and around an edge of the peripheral zone of the shell against the user.

18. The device for protecting against lesions according to claim 12, wherein a pulling lug is placed on an edge of the first coupling part of the fastening structure.

19. The device for protecting against lesions according to claim 18, wherein the pulling lug points upward and lies inside the peripheral zone of the shell.

20. The device for protecting against lesions according to claim 12, wherein the connecting part is elastic.

* * * * *